United States Patent [19]

Brunner et al.

[11] Patent Number: 4,681,272

[45] Date of Patent: Jul. 21, 1987

[54] ARRANGEMENT FOR POSITIVE SUPPLY OF ELASTOMER FILAMENTS IN TEXTILE MACHINES

[75] Inventors: Heinz Brunner, Albstadt; Stefan Seeger, Jungingen, both of Fed. Rep. of Germany

[73] Assignee: SIPRA Patententwicklungs-und Beteiligungsgesellschaft mbH, Albstadt, Fed. Rep. of Germany

[21] Appl. No.: 853,337

[22] Filed: Apr. 16, 1986

[30] Foreign Application Priority Data

Apr. 26, 1985 [DE] Fed. Rep. of Germany ..... 3515104

[51] Int. Cl.[4] ..... B65H 49/18; B65H 49/20; B65H 49/34; B65H 51/20

[52] U.S. Cl. ..... 242/47.01; 66/125 R; 66/132 R; 242/54 R; 242/128

[58] Field of Search ..... 242/47.01, 47.04, 47.05, 242/47.06, 47.07, 47.08, 47.09, 47.1, 47.11, 47.12, 47.13, 54 R, 128; 66/125 R, 132 R, 132 T

[56] References Cited

U.S. PATENT DOCUMENTS 3,209,558 10/1965 Cargill ..... 242/47.11 X
3,901,052 8/1975 Jacobsson ..... 66/132 T X

*Primary Examiner*—Stanley N. Gilreath
*Attorney, Agent, or Firm*—Michael J. Striker

[57] ABSTRACT

An arrangement for positively supplying elastomer fibers in a textile machine, comprises a device supplying a non-elastic filament fiber, a drive for driving the non-elastic filament fiber supplying device, a yarn spool for an elastomeric filament, a freely rotatable holder for the yarn spool, a drive roller arranged so that the yarn spool abuts against the drive roller over a predetermined abutment length, the drive roller being connected with the drive means and having a length which is greater than the predetermined abutment length, the drive roller having an axis extending in a predetermined plane, and a support which supports the spool holder and is longitudinally displaceable along a line such that the line or its projection extends in the plane of the axis of the drive roller and at an acute angle relative to the axis of the drive roller.

11 Claims, 1 Drawing Figure

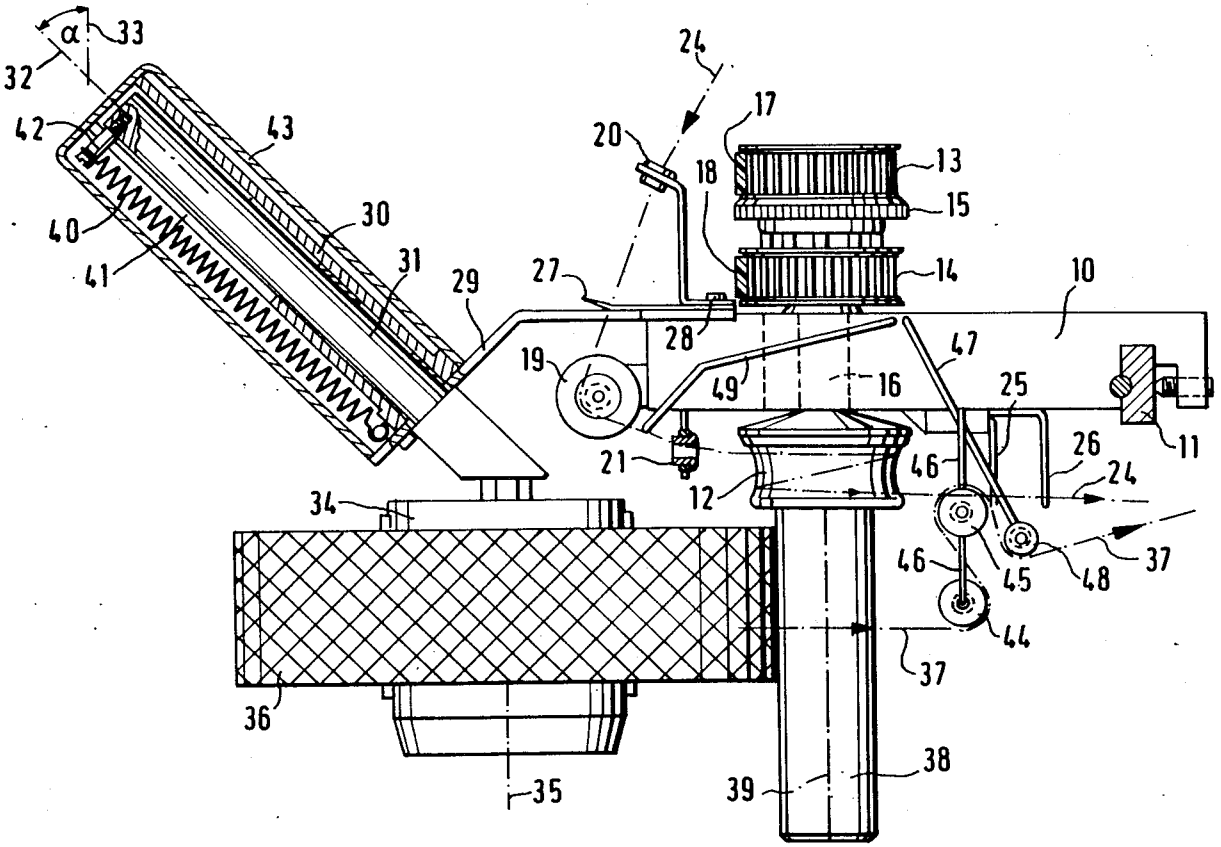
10
11
12
13
14
15
16
17
18
19
20
21
24
25
26
27
28
29
30
31
32
33
34
35
36
37
38
39
40
41
42
43
44
45
46
47
48
49
α

ARRANGEMENT FOR POSITIVE SUPPLY OF ELASTOMER FILAMENTS IN TEXTILE MACHINES

BACKGROUND OF THE INVENTION

The present invention relates to an arrangement for positively supplying elastomer filaments in textile machines. More particularly, it relates to the arrangement of the above mentioned general type which has a freely rotatable holder for a yarn spool abutting against a drive roller, and rollers for guiding elastomer filaments pulled from the yarn spool.

Arrangements of the above mentioned general type are known in the art. One of such arrangement is disclosed, for example, in the U.S. Pat. No. 3,901,052. In this arrangement the yarn spool is fitted on a holder whose support is displaceable under the action of the pulling spring normal to an axis of a drive roller. The fitted yarn spool abuts against the drive roller over the entire spool length. This arrangement is designed especially for elastomer filaments, and for the utilization with non-elastic filaments must be exchanged by other filament supplying arrangements which are provided with a filament supply drum. In this arrangement the spool assumes a constant abutment position relative to the drive roller and therefore involves the danger that loose yarn filaments abut against the drive roller and form an undesirable coating on the drive roller. For preventing this, the drive roller must be cleaned from time to time, since a coating on the drive roller damages the outer yarn layer of the abutting spool and the peripheral speed of the yarn spool and thereby the speed of pulling the filaments can be affected in an undesirable manner.

SUMMARY OF THE INVENTION

Accordingly, it is an object of the present invention to provide an arrangement of the above mentioned general type which avoids the disadvantages of the prior art.

More particularly, it is an object of the present invention to provide an arrangement of the above mentioned type which is formed so that it is exchangeable in a reliable and easy manner.

In keeping with these objects and with others which will become apparent hereinafter, one feature of the present invention resides, briefly stated, in an arrangement which comprises means for supplying a non-elastic filament fiber, drive means for driving the non-elastic filament fiber supplying means, a yarn spool for an elastomeric filament, a freely rotatable holder for the yarn spool, a drive roller arranged so that the yarn spool abuts against the drive roller over a predetermined abutment length, the drive roller being connected with the drive means and having a length which is greater than the predetermined abutment length, the drive roller having an axis extending in a predetermined plane, and a support which supports the spool holder and is longitudinally displaceable along a line such that the line or its projection extends in the plane of the axis of the drive roller and at an acute angle relative to the axis of the drive roller.

The support for the spool holder and the drive roller can be connected as additional parts to the parts of the filament supplying means for non-elastic filaments.

The arrangement designed in accordance with the present invention is connectable with the supplying means for non-elastic filaments in a space-economical manner. For processing of elastomer filaments, for example, on individual system of a multi-system circular knitting machine, no exchange of filament supplying means is necessary for the respective systems. Instead, the holding, driving and guiding parts provided for the elastomer filament spool can be simply introduced in the available filament supplying arrangement.

The inclined position of the longitudinal displaceable support for the elastomer filament spool provides various advantages. With reduced yarn spool diameter not only the spool axis approaches the axis of the drive roller, but simultaneously a longitudinal displacement of the yarn spool in the axial direction of the drive roller takes place. Thereby the deposit which can be formed on the surface of the drive roller are loosened in the axial direction and shoveled away, so that the drive roller obtains a self-cleaning effect. The inclined arrangement is also favorable for structural factors of this arrangement in the sense of a small space consumption both in radial direction and in axial direction. With the support which is inclined and displaceable downwardly, an automatic adjustment of the yarn spool can be achieved under the action of its own weight and without spring support. In textile machines with unfavorable space conditions at the mounting location, the support can however be arranged inclinded and upwardly displaceable by means of a spring force.

Theoretically, two or more elastomer yarn spools can be arranged on the spool holder coaxial with one another and abut against the common drive roller. It is advantageous when the arrangement is provided only with one elastomer yarn spool, since in this case at each processing location identical filament running paths between the yarn spool and the yarn processing location are provided, and individual yarn spools can have a different filling condition or a different convolution volume. The whole arrangement can be designed in a structurally simple manner and formed so that the filament supplying means can also operate with non-elastic filaments with the utilization of its filament supply drum, also when the holding, driving and guiding parts for the elastomer filaments remain mounted in the arrangement. If desired, the same arrangement can be used simultaneously for supplying a non-elastic filament and an elastomer filament positively to one or two processing stations.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing shows a filament supplying arrangement in accordance with the present invention, on a side view and partially sectioned.

DESCRIPTION OF THE PREFERRED EMBODIMENTS

A filament supplying arrangement has a housing which is identified with reference numeral 10 and formed as a hollow body. The housing is connected by screws in its end region with a mounting rail 11 of a textile machine, in a horizontal position. A throughgoing vertical shaft 16 is arranged in the housing 10. A filament supplying drum 12 is mounted at the lower side of the housing 10 on the shaft 16. Two belt pulleys 13 and 14 are supported on the shaft 16 at the upper side of the housing 10. The belt pulleys 13 and 14 are selectively connectable with the shaft 16 by means of an axially displaceable coupling disc 15 located between both belt pulleys. Belts 17 and 18 are guided by the belt pulleys 13 and 14. The belts 17 and 18 are common for several identical filament supplying arrangements and driven by a not shown common drive.

The free end of the housing 10 is provided with a filament brake 19, a knot controller 27, an upper filament guiding eye 20 and a lower filament guiding eye 21. They are designed for non-elastic filaments 24 identified by a dash-dot line and guided in several convolutions over the filament supplying drum 12 and thereafter over bracket-shaped filament guiding elements 25 and 26, and then can be pulled over a not shown filament breakage sensor. The above described construction of the filament supplying arrangement is known in the art.

For supplying an elastomer filament, the filament supplying arrangement is provided with additional elements. A bent supporting arm 29 is releasably mounted in the free end region of the housing 10 by means of a screw 28 which simultaneously serves for a holder of the upper filament guiding eye 20. The supporting arm 29 is provided with a through opening through which a guiding sleeve 30 for a lonitudinally displaceable bar 31 is mounted at the end side. The axis 32 of the guiding sleeve 30 and the bar 31 extends at an angle of 45° to a vertical plane 33. The longitudinally displaceable bar 31 serves as a support for a yarn spool holder 34 which is held freely rotatably about a vertical axis 35 on the bar 31 and more particularly on its free lower end extending beyond the guiding sleeve 30. A yarn spool 36 with elastomer filaments 37 wound thereon is fitted on the spool holder 34 with a frictional connection therebetween.

Under the action of the weight of the yarn spool holder 34 and the yarn spool 36, the bar 31 is brought into abutment against a drive roller 38. The drive roller 38 is arranged coaxial to the filament supplying drum 12 and thereby also coaxial with the axis 39 of the shaft 16 so as to form an extension of the filament supplying drum 12. The drive roller 38 is fixedly connected with the filament supplying drum 12 and has a considerably greater length than the abutment length of the yarn spool 36. The abutment of the yarn spool 36 is supported by a pulling spring 40. The pulling spring 40 is connected with its one end to the guiding sleeve 30 and with its other end to a pin 42 which is anchored in the bar 31 and extends outwardly through a longitudinal slot 41 of the guiding sleeve 30. The whole supporting device is covered in a dustprotective manner by means of a protective housing 43 which can be formed as a simple socket cap.

The drive roller 38 can be formed of one piece with the filament supplying drum 12. On the other hand, advantageously it can be releasably connected with the filament supplying drum 12 in a not shown manner, for example by means of a screw connection or a bayonet-type rotary socket connection. The elastomer filament 37 is not guided over the the filament supplying drum 12, as the non-elastic filament 24, but instead it is pulled over to the guiding rollers 44 and 45. These rollers are arranged on supporting rods 46 which are fixed in the housing 10, and are offset to a plane extending through the axes 35 and 39. Thereby the pulled elastomer fibers 37 do not contact the drive roller 38. A turning lever 47 is a part of the sensor of a filament breakage-monitoring device arranged in the interior of the housing 10. This device is known in the art and it also included a turning lever 49 which cooperates with a non-elastic filament 24. Both turning levers 47 and 49 form respective sensors and are turnably supported in the housing 10.

The supporting part for the spool holder 34 can also be arranged in a different manner. For example, the bar 31 can be arranged under the spool holder 34 in inclined and upwardly displaceable way. The angle must not necessarily be equal to 45°, but also can have other values. The axes 35 and 39 must not necessarily extend parallel to one another and lie in a common plane. Also conical yarn spools can be used in the inventive arrangement.

Finally, the arrangement can be designed without the filament supplying drum 12. In this case, the shaft 16 transits immediately into the drive roller 38. In this case, also the filament guiding elements 19, 20, 21, the knot controllers 27, and the sensor 49 can be dispensed with.

It will be understood that each of the elements described above, or two or more together, may also find a useful application in other types of constructions differing from the types described above.

While the invention has been illustrated and described as embodied in a filament supplying arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for positively supplying elastomer fibers in a textile machine, comprising drive means; a yarn spool for an elastomeric filament; a freely rotatable spool holder for said yarn spool; a drive roller arranged so that said yarn spool abuts against said drive roller over a predetermined abutment length said drive roller drivable by said drive means and having a length which is greater than said predetermined abutment length, said drive roller having an axis extending in a predetermined plane; and a support which supports said spool holder and is longitudinally displaceable along a line such that said line or its projection extends in said plane of said axis of said drive roller and at an acute angle relative to said axis of said drive roller.

2. An arrangement as defined in claim 1; and further comprising rollers for guiding an elastomer filament which is pulled from said yarn spool.

3. An arrangement as defined in claim 1; and further comprising filament supply means including a supply drum connected with said drive means, said drive roller being connected with said supply drum coaxially and in a fixed manner for joint rotation therewith.

4. An arrangement as defined in claim 1, wherein said support for said spool holder is arranged displaceably at an angle of substantially 45° relative to said axis of said drive roller.

5. An arrangement as defined in claim 1, wherein said support for said spool holder is formed as a sleeve and a bar which is longitudinally displaceably arranged in said sleeve and has a free end which carries said spool holder in a freely rotatable manner.

6. An arrangement as defined in claim 5; and further comprising a spring which biases said bar in a direction toward said drive roller.

7. An arrangement as defined in claim 1, wherein said support for said spool holder is arranged inclined and downwardly displaceably, so that said yarn spool with said spool holder is suspended on said support.

8. An arrangement as defined in claim 1; and further comprising a housing, said support for said spool holder forming a first element and said drive roller forming a second element, at least one of said elements being releasably connected with said housing.

9. An arrangement as defined in claim 1; and further comprising non-elastic filament supplying means including a supply drum, said support for said spool holder forming a first element and said drive roller forming a second element, at least one of said elements being releasably connected with said supply drum.

10. An arrangement as defined in claim 1; and further comprising a dust-tight protective housing arranged so that it surrounds said support for said yarn holder.

11. An arrangement as defined in claim 1, wherein said yarn spool has an axis of rotation, said axis of said drive roller and said axis of rotation of said yarn spool extending in a certain plane; and further comprising a plurality of filament guiding rollers for an elastomer filament and arranged so that they are offset relative to said certain plane so that the elastomer fiber does not contact said drive roller.

* * * * *